US006916533B2

(12) United States Patent
Simmelink et al.

(10) Patent No.: US 6,916,533 B2
(45) Date of Patent: Jul. 12, 2005

(54) HIGHLY ORIENTED POLYOLEFIN FIBRE

(75) Inventors: Joseph A. P. M. Simmelink, Sittard (NL); Jacobus J. Mencke, Maastricht (NL)

(73) Assignee: DSM IP Assets B.V., Heerlen (NL)

( * ) Notice: Subject to any disclaimer, the term of this patent is extended or adjusted under 35 U.S.C. 154(b) by 0 days.

(21) Appl. No.: 10/781,915

(22) Filed: Feb. 20, 2004

(65) Prior Publication Data

US 2004/0161605 A1 Aug. 19, 2004

Related U.S. Application Data

(62) Division of application No. 09/844,247, filed on Apr. 30, 2001, now Pat. No. 6,723,267, which is a continuation of application No. PCT/NL99/00099, filed on Feb. 24, 1999.

(60) Provisional application No. 60/129,935, filed on Apr. 19, 1999.

(30) Foreign Application Priority Data

Oct. 28, 1998 (NL) ..... 1010413

(51) Int. Cl.[7] ..... D01F 6/00

(52) U.S. Cl. ..... 428/364; 428/394; 428/372; 57/200

(58) Field of Search ..... 428/364, 394, 428/372; 57/200; 2/2.5; 89/36.05

(56) References Cited

U.S. PATENT DOCUMENTS

| | | | | |
|---|---|---|---|---|
| 4,413,110 | A | | 11/1983 | Kavesh et al. |
| 4,422,993 | A | | 12/1983 | Smith et al. |
| 4,457,985 | A | | 7/1984 | Harpell et al. |
| 4,501,856 | A | | 2/1985 | Harpell et al. |
| 4,545,950 | A | | 10/1985 | Motooka et al. |
| 4,550,044 | A | | 10/1985 | Rosenberg et al. |
| 4,650,710 | A | | 3/1987 | Harpell et al. |
| 4,681,792 | A | | 7/1987 | Harpell et al. |
| 5,106,563 | A | | 4/1992 | Yagi et al. |
| 5,395,671 | A | | 3/1995 | Coppage, Jr. et al. |
| 5,480,712 | A | * | 1/1996 | Takahashi et al. ..... 428/316.6 |
| 5,660,913 | A | | 8/1997 | Coppage, Jr. |
| 5,756,660 | A | | 5/1998 | Shiraishi et al. |
| 5,766,725 | A | | 6/1998 | Hogenboom et al. |
| 5,972,498 | A | | 10/1999 | Kavesh et al. |
| 6,127,291 | A | | 10/2000 | Coppage, Jr. et al. |

FOREIGN PATENT DOCUMENTS

| | | |
|---|---|---|
| EP | 064 167 | 11/1982 |
| EP | 205960 | 12/1986 |
| GB | 2 042 414 | 9/1980 |
| JP | 60/151311 | 8/1985 |
| WO | 93/12276 | 6/1993 |
| WO | 97/00766 | 1/1997 |
| WO | 97/11037 | 3/1997 |

* cited by examiner

*Primary Examiner*—N. Edwards
(74) *Attorney, Agent, or Firm*—Mayer Brown Rowe & Maw LLP

(57) ABSTRACT

The invention relates to a highly oriented polyolefin fiber containing polyolefin with an intrinsic viscosity of at least 5 dl/g, which fiber has a tensile strength of at least 26 cN/dtex and a modulus of tension of at least 700 cN/dtex, a process for the preparation thereof and the use in ropes or anti-ballistic shaped articles. The invention also relates to improved ropes and anti-ballistic shaped articles. The highly oriented polyolefin fiber according to the invention has improved properties in applications such as, in particular, anti-ballistic shaped articles since the fiber contains 0.05–5 wt. % of a solvent for the polyolefin (relative to the total fiber weight).

26 Claims, No Drawings

HIGHLY ORIENTED POLYOLEFIN FIBRE

CROSS REFERENCE TO RELATED APPLICATION

This application is a divisional application of Ser. No. 09/844,247, filed Apr. 30, 2001 now U.S. Pat. No. 6,723,267, which in turn is a continuation of PCT/NL99/00099 filed Feb. 24, 1999, and which further claims benefit of priority to provisional application Ser. No. 60/129,935, filed Apr. 19, 1999, all of which are incorporated by reference herein.

The invention relates to a highly oriented polyolefin fibre containing polyolefin with an intrinsic viscosity of at least 5 dl/g, which fibre has a tensile strength of at least 26 cN/dtex and a modulus of tension of at least 700 cN/dtex, a process for the preparation thereof and the use in ropes or anti-ballistic shaped articles. The invention also relates to improved ropes and anti-ballistic shaped articles.

The said highly-oriented polyolefin fibres are known from EP-A-0.205.960. The highly oriented polyolefin fibres described there have a very high tensile strength and modulus of tension and a low creep rate, making them particularly suitable for use in, inter alia, ropes and anti-ballistic shaped articles. The fibres are prepared by spinning a solution of a polyolefin into a gel fibre, extracting the solvent from the fibre, and drawing the extracted and dried fibre in one or more steps.

However, there is an ongoing need for further improvement of the quality of such fibres, or at least for optimization of the properties of the fibres to such an extent that the quality of the products, such as ropes and anti-ballistic shaped articles, made from these fibres can be improved. The aim of the invention therefore is to provide highly oriented polyolefin fibres with improved properties in said applications.

Surprisingly, this aim is achieved in that the fibre contains 0.05–5 wt. % of a solvent for the polyolefin (relative to the fibre's total weight).

It has been found that the fibres according to the invention are eminently suitable for use in anti-ballistic shaped articles since shaped articles on the basis of these fibres have a high Specific Energy Absorption (SEA), which means that less fibre, and hence less weight, is needed to obtain the same level of protection. It has also been found that the fibres according to the invention are suitable for use in ropes, inter alia because their compactness is better without any loss in flexibility and because the strength of the ropes is enhanced.

The improved quality of the fibres is particularly surprising since up to now the presence of a significant amount of solvent in the fibre has been considered undesirable as this reduces the mechanical properties of the fibre, in particular because the fibre's creep rate is higher and its strength and modulus are lower. It is also surprising that solvent-containing fibres have a higher anti-ballistic quality than "dry" fibres of comparable strength and modulus, for in itself the solvent cannot contribute to the level of protection, while it does increase the areal density.

Fibres that contain solvent are known in the state of the art. However, these fibres are not highly oriented and they are unsuitable for the desired applications as their mechanical properties are not good enough. Within the context of the present application, highly oriented is understood to mean that the fibre has a modulus of tension of at least 700 cN/dtex and a tensile strength of at least 26 cN/dtex (as determined according to the method specified below). The known solvent-containing fibres are intermediates in a process in which the fibre is prepared from a solution. The description makes it clear that the solvent is undesirable in the end product and therefore still needs to be removed. U.S. Pat. No. 5,213,745, for example, describes optimum extraction agents for the removal of mineral oil solvent from an undrawn gel fibre. This publication does not describe solvent-containing, highly oriented polyolefin fibres. EP-A-0,115,192 describes fibres having a high solvent content and a low tensile strength and modulus of tension. These fibres, too, are intermediates, and as such unsuitable for use in the said applications.

The tensile strength (or strength) and the modulus of tension (or modulus) are defined and are determined as specified in ASTM D885M, using a nominal gauge length of the fibre of 500 mm, a crosshead speed of 50%/min and Instron 2714 clamps. Before the measurement the fibre is twisted at 31 turns per metre. On the basis of the measured stress-strain curve the modulus is determined as the gradient between 0.3 and 1% strain. For calculation of the modulus and strength, the tensile forces measured are divided by the titer, as determined by weighing 10 metres of fibre. Creep is here and hereinafter understood to be the elongation as a percentage of the original length after 5 hours under a load of 8.11 gr/dtex at 50° C. The elongation includes the elastic elongation.

A fibre is understood to be a continuous or semi-continuous object such as a monofilament, multifilament yarn, tapes or staple fibre yarn. In principle, the filaments may have any cross-sectional shape and thickness. Preferably, the filament titer is at most 5, more preferably at most 3 denier per filament. The advantage of such a low filament titer is that the fibre has better anti-ballistic properties.

Varying polyolefins can be used in the fibre according to the invention. Particularly suitable polyolefins are homo- and copolymers of polyethylene and polypropylene. In addition, the polyolefins used may contain small amounts of one or more other polymers, in particular other alkene-1-polymers. Good results are achieved if linear polyethylene (PE) is chosen as polyolefin. Linear polyethylene is here understood to be polyethylene with fewer than one side chain per 100 carbon atoms, and preferably fewer than one side chain per 300 carbon atoms, which may moreover contain up to 5 mol % of or more alkenes that can be copolymerized with it, such as propylene, butene, pentene, 4-methylpentene or octene. Besides the polyolefin and the solvent the fibre may contain small amounts of the additives that are customary for such fibres, such as anti-oxidants, spinfinish, thermal stabilizers, colourants, etc.

Preferably, the polyolefin fibre, in particular the polyethylene fibre, has an intrinsic viscosity (IV) of more than 5 dl/g. Because of their long molecule chains, polyolefin fibres with such an IV have very good mechanical properties, such as a high tensile strength, modulus, energy absorption at break. This is also the reason why even more preferably the polyolefin is a polyethylene with an IV of more than 10 dl/g. The IV is determined according to method PTC-179 (Hercules Inc. Rev. Apr. 29, 1982) at 135° C. in decalin, the dissolution time being 16 hours, the anti-oxidant is DBPC, in an amount of 2 g/l solution, and the viscosity at different concentrations is extrapolated to zero concentration.

To ensure a good anti-ballistic effect, the tensile strength of the fibre is at least 26 cN/dtex and the modulus at least 700 cN/dtex. Preferably, the modulus is at least 880 cN/dtex, more preferably at least 1060 cN/dtex, and most preferably at least 1235 cN/dtex. The strength is preferably at least 31 cN/dtex, more preferably at least 33 cN/dtex, and most preferably at least 35 cN/dtex. Surprisingly, it has been found that at relatively low, but for the purpose of the invention effective, solvent concentrations, the creep of such a highly oriented fibre is only to a very low extent adversely affected by the solvent. Preferably, the fibre according to the invention has a tensile strength of at least 26 cN/dtex, a modulus of at least 700 cN/dtex, a solvent content of 0.05–2 wt. % and a creep of at most 20%, more preferably at most 15%, even more preferably at most 10% and most preferably at most 5%. Such a low creep is favourable in particular for use in ropes. When use is made of copolymer with more than 2 short side chains per 1000 carbon atoms, the creep can be reduced further. Preferably, the creep then is at most 10% and more preferably at most 5%.

Solvent is here and hereinafter understood to be a substance that is capable of dissolving the polyolefin in question. Suitable solvents for polyolefins are known to one skilled in the art. They can, for example, be chosen from the 'Polymer Handbook' by J. Brandrup and E. H. Immergut, third edition, chapter VII, pages 379–402. Preferably, use is made of a solvent with a chi-parameter for the polyolefin used, in particular polyethylene, of less than 0.5, more preferably less than 0.45, even more preferably less than 0.4, and most preferably less than 0.35. Chi-parameters of solvents are presented in Handbook of sol. parameters and other cohesion parameters, 2nd edition, published by Allan Barton, p. 386. This has the advantage that, at the same solvent content, the quality improvement can be greater, mutatis mutandis, that less solvent is needed to achieve the same improvement in anti-ballistic properties. Examples of suitable solvents for polyolefin, in particular for polyethylene, are, separately or in combination: decalin, tetralin, toluene, lower n-alkanes such as hexane, (para-) xylene, paraffin oil, squalane, mineral oil, paraffin wax, cyclooctane. For the reasons cited above, the solvent is most preferably paraffin oil or decalin.

Preferably, the solvent is a non-volatile solvent, such as paraffin oil. This has the advantage that the fibre has a better stability, which means that the properties of the fibre, and of the products based on it, do not deteriorate with time and that the useful service life is longer. Another advantage is that the fibre does not have such a bad smell and is not toxic or detrimental to health, which is relevant in particular in body protection applications. A non-volatile solvent is understood to be a solvent that virtually does not evaporate at a temperature below the melting temperature of the polyolefin. Preferably, these are solvents having a boiling temperature that is substantially, preferably 50 to 100° C., higher than the fibre's melting temperature.

The fibre according to the invention contains 0.05–5 wt. % of a solvent for polyolefin. Solvent contents below 0.05 wt. % have no or hardly any effect. Contents higher than 5 wt. % have the disadvantage that they no longer essentially contribute to the improvement in, or even impair, the anti-ballistic properties. The SEA increases with the solvent content up to a certain optimum solvent content, at which the contribution to the energy absorption no longer compensates for the increase in areal density and above which the SEA drops again. Although a higher than optimum solvent content in the shaped article ultimately obtained may be advantageous, since solvent is cheaper than fibres, the solvent content is preferably chosen with a view to obtaining the highest possible anti-ballistic quality. The optimum solvent content also depends on the fibre configuration, the quality of the solvent chosen, and the compression conditions. On the basis of the guidelines given here, one skilled in the art can determine the optimum amount for each process condition. For the above reasons, the solvent content in the fibre is preferably from 0.1 to 3 wt. %, more preferably 0.2–2 wt. %, even more preferably 0.2–1.2 wt. %, and most preferably 0.3–1.0 wt. %. Such low solvent contents are preferably used for good solvents, in particular solvents having a chi-parameter lower than 0.5, and for use in uni-directional composites. The solvent content of the fibres can be determined in a known way, for example directly by means of infrared techniques, C13 NMR, or indirectly by solvent removal, for example by extraction or head-space chromatography or combinations of said techniques.

The fibre according to the invention can be prepared by contacting a highly oriented "dry" polyolefin fibre with a solvent for the polyolefin, with the fibre taking up 0.05–5 wt. % of the solvent. The highly oriented "dry" polyolefin fibre may have been prepared in a known way from the polyolefin polymer, for example by gel spinning (Smith and Lemstra), by solid phase processing of virgin reactor powder (Chanzy and Smith), by extrusion from the melt (Ward) or by extrusion from powder recrystallized from solution (Kanamoto) with one or more drawing steps to increase the orientation.

Preferably, the fibre is prepared directly in a gel spinning process. The invention also relates to a process for the preparation of a highly oriented polyolefin fibre according to the invention comprising: forming a solution of a polyolefin in a solvent, forming a gel fibre by extruding this solution through one or more spinning apertures and subsequently cooling it to obtain a gel fibre, removing the solvent from the gel fibre and drawing the fibre in one or more steps. Such a process is known from EP-A-0,205,960. For the preparation of the fibre according to the invention this process is adapted in that not all of the solvent is removed from the gel fibre resulting, after one or more drawing steps, in the formation of a solvent containing precursor which is subsequently, at a temperature above the equilibrium melting temperature of the polyolefin, drawn to obtain the highly oriented polyolefin fibre containing 0.05 to 5 wt. % of solvent.

An advantage of the process according to the invention is that fewer steps are needed for the preparation of the fibre and that the fibre obtained by this process has better anti-ballistic properties than a fibre of comparable strength and modulus to which a similar amount of solvent has been added in another manner. A further advantage of the process according to the invention, for example compared with the processes described in EP-A-0,205,960, is that less fibre breakage occurs during drawing of the solvent-containing precursor fibre to a highly oriented fibre, at otherwise unchanged conditions. As a result, there are fewer production stops and a higher productivity can be achieved.

The precursor fibre may have been formed in a single step by simultaneous drawing and solvent removal or by separate solvent removal and drawing steps. The solvent content in the precursor fibre is chosen so that the end product, the highly oriented polyolefin fibre, contains the desired amount of solvent, between 0.05 and 5 wt. %, after drawing. It is possible that part of the solvent is removed during the last drawing step. Preferably, however, a non-volatile solvent is used, with the solvent content during drawing of the precursor fibre in the last drawing step being virtually constant. This has the advantage of better drawing process control, resulting in better drawability.

In one embodiment of the process the solvent in the highly oriented polyolefin fibre is the same as the solvent of the solution from which spinning takes place. The solvent content of the precursor fibre can be set by incomplete solvent removal, for example by shortening the evaporation or extraction time or by influencing the evaporation or extraction rate.

In a particularly preferred embodiment of the process according to the invention, the solvent substantially consists of a mixture of a first solvent (A) and a second solvent (B), with (A) being removed and (B) remaining in the fibre.

The physico-chemical properties of these solvents (A) and (B) are so different that the solvent removal technique employed results in removal of (A) while solvent (B) substantially remains in the fibres. The advantage of this embodiment is that the amount of solvent (B) in the precursor fibre can be set directly and more accurately through the choice of the spinning solvent composition, without major changes in the other process parameters. In the light of the aim of the invention it is not necessary for the amount of (B) present in the solution during removal of (A) and/or drawing to remain completely in the fibre, but for process control purposes it is advantageous if the full amount of (B) remains in the fibre, at any rate during the removal of (A), so as to prevent contamination of the process. For this reason, (B) preferably almost entirely remains in the fibre also during drawing. There is no need for (A) to be fully removed, but for process control reasons (A) is preferably fully removed. Preferably, the content of (A) in the fibre is not higher than 0.5 wt. %, preferably lower than 0.3 wt. %, more preferably lower than 0.2 wt. %, and most preferably lower than 0.1 wt. %.

In an embodiment of the said process (B) has a higher boiling point than (A) and (A) is removed by evaporation at a temperature at which no or hardly any evaporation of (B) takes place. Preferably, the boiling temperature of (B) is chosen so that no or hardly any evaporation of (B) takes place at the drawing temperature, either. This has the advantage that drawing is better controlled since the fibre composition does not change during drawing and since the fibre is not cooled by withdrawal of the heat of solvent evaporation.

In the most preferred embodiment (B) is a non-volatile paraffin in the process and (A) a volatile solvent, preferably decalin. An added advantage of this embodiment over the embodiment mentioned earlier is that the solvent mixture is much less viscous than just paraffin as solvent, so that paraffin-containing fibres with low filament titers, in particular filament titers lower than 5 and preferably lower than 3, can more readily be prepared.

In another embodiment of the process (B) has a higher melting temperature than (A) and (A) is removed by extraction at a temperature at which no or hardly any extraction of (B) takes place. Preferably, (B) then is a paraffin wax and (A) paraffin oil.

The solvent-containing precursor fibre is drawn to a highly oriented polyolefin fibre at a temperature above approximately the equilibrium melting temperature of the polyolefin. The equilibrium melting temperature of the polyolefin is understood to be the peak temperature of the melting curve of the polyolefin powder, measured using a DSC at a heating-up rate of 10° C. a minute. For polyethylene fibres this is preferably above about 140° C. Obviously, the drawing temperature is not chosen so high that effective drawing can no longer take place. Most preferably, the drawing temperature is between 145 and 160° C. and the solvent content of the precursor fibre during the last drawing step is everywhere between 0.05 and 5 wt. %. This has the advantage of a good productivity in combination with a very good strength and modulus.

The invention also relates to a highly oriented polyolefin fibre obtainable by the process described above. This fibre has better anti-ballistic properties than a fibre with otherwise comparable properties to which a similar amount of solvent has been added in a different way.

The invention also relates to the use of highly oriented polyolefin fibres according to the invention for the manufacture of ropes and to ropes containing highly oriented polyolefin fibres according to the invention. Compared with solvent-free fibres with comparable properties, the solvent-containing fibres can more easily be processed into ropes. The ropes are more compact, their feel is less woolly, and yet their flexibility is good. It has been found that the rope is also stronger.

The invention also relates to the use of the highly oriented fibres according to the invention as described above for the manufacture of anti-ballistic shaped articles. The advantage of the use of these fibres is in particular that the customary process for the preparation of these shaped articles can be used without essential modifications. Such processes are disclosed, for example, in WO97/00766 and WO95/00318. A major added advantage is that, for example in contrast with fibres or fibre layers that are wetted afterwards, the process equipment is not fouled with solvent.

The invention also relates to anti-ballistic shaped articles that contain highly oriented polyolefin fibres according to the invention. Compared with shaped articles on the basis of solvent-free fibres, these shaped articles have a higher anti-ballistic protection level at a comparable areal density. Preferably, the anti-ballistic shaped article according to the invention has a specific energy absorption (SEA) when hit by an AK47 MSC point of at least 115 J/kg/m$^2$, preferably more than 120 J/kg/m$^2$, even more preferably more than 135 J/kg/m$^2$, and most preferably more than 145 J/kg/m$^2$.

The invention will be elucidated on the basis of the following examples.

Woven Fabric:

COMPARATIVE EXPERIMENT A

SK76 Dyneema yarn without paraffin was woven into a simple fabric with 8 yarns/cm in the warp and the weft. The areal density of the woven fabric was 318 gr/m$^2$. Twenty layers of this fabric were compressed to form flat panels with 60 micron Stamylex (LLDPE) film between each layer. The pressure was 10 bar, the temperature was 125° C. and the compression time was 20 min. After this compression time the panels were cooled while the pressure was maintained. The V50 was determined according to the Stanag 2920 standard test using 17 grain FSP. The V50 was 532 m/s, corresponding to an energy absorption (SEA) of 21.4 J/kg/m$^2$.

The properties of the SK76 yarn employed are:

| | |
|---|---|
| Strength: | 36.0 cN/dtex |
| Modulus: | 1180 cN/dtex |
| Creep: | 4.1% |

Woven Fabric:

EXAMPLE 1

SK76 Dyneema yarn with a particular paraffin content was prepared by gel spinning under the conditions usually used for SK76 yarns, from a solution of UHMWPE and a volatile solvent to which a particular amount of paraffin had been added. Dünflussig paraffin from Merck having a dynamic viscosity of 25–80 MPa/.sec and a density of 0.818–0.875 gr/cm$^3$ was used as the paraffin. The specified paraffin content was calculated on the basis of the percentage of paraffin added to the solvent at complete retention of the paraffin in the fibre during the fibre production process.

A panel was produced and tested according to Comparative Experiment A, except that SK76 yarns containing approximately 0.8% paraffin solvent were used. The strength, modulus and creep of the yarn were the same as those of the solvent-free yarn. The areal density of the woven fabric was 302 g/m$^2$. The resulting V50 of the solvent-containing panel was 560 m/s, corresponding to an energy absorption of 24 J/kg/m2

Twill Woven Fabric:

COMPARATIVE EXPERIMENT B

Dyneema SK75 yarns without solvent were woven to form a twill 3/1 style fabric with 3.75 yarns/cm in the warp and the weft and an AD of 276 g/m$^2$0.22 Layers of this fabric were compressed to form panels with 30 micron Stamylex (LLDPE) film between the layers and tested in a way as specified in Example 4. The V50 was 534 m/s, corresponding to an SEA of 23.8 J/kg/m$^2$.

The yarn properties of the SK75 yarn used (measured as in comparative experiment A):

| | |
|---|---|
| Strength: | 35.1 CN/dtex |
| Modulus: | 1130 CN/dtex |

Twill Woven Fabric:

EXAMPLE 2

A twill woven fabric as in Comparative Experiment B was produced, only now using SK75 fibres containing approximately 2000 ppm decalin. Although the yarn properties were the same, the V50 of the panels was higher, namely 600 m/s, corresponding to an SEA of 28 J/kg/m$^2$.

UD Composite:

COMPARATIVE EXPERIMENT C AND EXAMPLES 3–7

SK76 and SK75 Dyneema yarns with different concentrations of paraffin, produced as described in Example 1, were processed to form monolayers of unidirectionally oriented yarns bound in a Kraton matrix (isopropene-styrene copolymer from Shell). Four monolayers were formed into a UD stack in which the fibre direction in each monolayer was at an angle of 90 degrees with respect to the fibre direction in the neighbouring layer. 75 of such UD stacks were compressed to form an anti-ballistic shaped article at a temperature of 125° C. and a pressure of 165 bar for 35 minutes. The shaped article was cooled with water while the pressure was maintained. The shaped articles were tested according to the Stanag 2920 standard using AK47 MSC rounds. The yarn properties had not been affected by the addition of the paraffin.

| | Fibre | Paraffin (%) | V50 (m/s) |
|---|---|---|---|
| C | SK75 | 0 | <710 |
| 3 | SK75 | 0.4 | 730 |
| 4 | SK75 | 0.8 | 780 |
| 5 | SK76 | 0.4 | 750 |
| 6 | SK76 | 0.8 | 780 |
| 7 | SK76 | 1.2 | 810 |

Rope:

EXAMPLES 8, 9 AND 10

From SK76 Dyneema yarns with different paraffin contents (prepared according to Example 1, all having a titer of 1760 dtex per yarn) three braids (v1, v2 and v3) were made on a 16-position Herzog braiding machine. The resulting braid had 2.75 stitches/cm. The braids were very compact and yet very supple. The braids were tested on a Zwick 1484 tensile tester with Zwick 8465 type clamps and a crosshead speed of 150 mm/min. The nominal gauge length between these clamps is 2600 mm (see table below).

| % paraffin Tensile strength | CN/dtex |
|---|---|
| 0.4 | 21.7 |
| 0.8 | 21.9 |
| 1.2 | 22.1 |

What is claimed is:

1. Highly oriented polyolefin fiber containing polyolefin with an intrinsic viscosity (in decalin at 135° C.) of at least 5 dl/g, which fiber has a tensile strength of at least 26 cN/dtex and a modulus of tension of at least 700 cN/dtex, wherein the fiber contains 0.05–5 wt. % of a solvent for the polyolefin (relative to the total fiber weight) and wherein the fiber has a creep, defined as the elongation as a percentage of the original length after 5 hours under a load of 8.11 gr/dtex at 50° C., of at most 10%.

2. Highly oriented polyolefin fiber according to claim 1, wherein the polyolefin is polyethylene.

3. Highly oriented polyolefin fiber according to claim 2, wherein the creep is at most 5%.

4. Highly oriented polyolefin fiber according to claim 3, wherein the polyethylene is a copolymer with more than 2 short side chains per 1000 carbon atoms.

5. Highly oriented polyolefin fiber according to claim 3, wherein the polyethylene is a copolymer with more than 2 short side chains per 1000 carbon atoms.

6. Highly oriented polyolefin fiber according to claim 1, wherein the chi-parameter of the solvent for the polyolefin is lower than 0.5.

7. Highly oriented polyolefin fiber according to claim 2, wherein the chi-parameter of the solvent for the polyolefin is lower than 0.5.

8. Highly oriented polyolefin fiber according to claim 3, wherein the chi-parameter of the solvent for the polyolefin is lower than 0.5.

9. Highly oriented polyolefin fiber according to claim 1, wherein the solvent is non-volatile.

10. Highly oriented polyolefin fiber according to claim 2, wherein the solvent is non-volatile.

11. Highly oriented polyolefin fiber according to claim 3, wherein the solvent is non-volatile.

12. Highly oriented polyolefin fiber according to claim 1, wherein the solvent is a paraffin oil.

13. Highly oriented polyolefin fiber according to claim 2, wherein the solvent is a paraffin oil.

14. Highly oriented polyolefin fiber according to claim 3, wherein the solvent is a paraffin oil.

15. Highly oriented polyolefin fiber according to claim 1, wherein the fiber contains 0.1–2 wt. % of the solvent.

16. Highly oriented polyolefin fiber according to claim 2, wherein the fiber contains 0.1–2 wt. % of the solvent.

17. Highly oriented polyolefin fiber according to claim 3, wherein the fiber contains 0.1–2 wt. % of the solvent.

18. Highly oriented polyolefin fiber according to claim 1, wherein the fiber has a fineness of less than 5 denier per filament.

19. Highly oriented polyolefin fiber according to claim 2, wherein the fiber has a fineness of less than 5 denier per filament.

20. Highly oriented polyolefin fiber according to claim 3, wherein the fiber has a fineness of less than 5 denier per filament.

21. Rope comprising highly oriented polyolefin fibers according to claim 1.

22. Rope comprising highly oriented polyolefin fibers according to claim 2.

23. Rope comprising highly oriented polyolefin fibers according to claim 3.

24. Anti-ballistic shaped article comprising highly oriented polyolefin fibers according to claim 1.

25. Anti-ballistic shaped article comprising highly oriented polyolefin fibers according to claim 2.

26. Anti-ballistic shaped article comprising highly oriented polyolefin fibers according to claim 3.

* * * * *